US006322427B1

(12) United States Patent
Li et al.

(10) Patent No.: US 6,322,427 B1
(45) Date of Patent: Nov. 27, 2001

(54) CONDITIONING FIXED ABRASIVE ARTICLES

(75) Inventors: Shijian Li, San Jose; Sidney Huey, Milpitas; Ramin Emami, San Jose; Fritz Redeker, Fremont; John White, Haywood, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/302,530

(22) Filed: Apr. 30, 1999

(51) Int. Cl.[7] ..... B24B 1/00
(52) U.S. Cl. ..... 451/56; 451/443
(58) Field of Search ..... 451/56, 28, 41, 451/63, 268, 269, 270, 285, 287, 288, 443, 444, 526, 539

(56) References Cited

U.S. PATENT DOCUMENTS

| | | | | |
|---|---|---|---|---|
| 5,014,468 | | 5/1991 | Ravipati et al. . | |
| 5,437,754 | | 8/1995 | Calhoun . | |
| 5,453,312 | | 9/1995 | Haas et al. . | |
| 5,454,844 | | 10/1995 | Hibbard et al. . | |
| 5,472,371 | * | 12/1995 | Yamakura et al. | 451/56 |
| 5,692,950 | | 12/1997 | Rutherford et al. . | |
| 5,725,417 | * | 3/1998 | Robinson | 451/56 |
| 5,738,574 | * | 4/1998 | Tolles et al. | 451/287 |
| 5,820,450 | | 10/1998 | Calhoun . | |
| 5,823,855 | * | 10/1998 | Robinson | 451/41 |
| 5,842,910 | | 12/1998 | Krywanczyk et al. . | |
| 5,879,222 | * | 3/1999 | Robinson | 451/41 |
| 5,879,226 | * | 3/1999 | Robinson | 451/56 |
| 5,916,012 | * | 3/1999 | Pant et al. | 451/296 |
| 5,961,372 | * | 10/1999 | Shendon | 451/56 |
| 5,990,010 | * | 11/1999 | Berman | 438/691 |

* cited by examiner

*Primary Examiner*—Derris H. Banks
(74) *Attorney, Agent, or Firm*—Moser, Patterson & Sheridan

(57) ABSTRACT

The useful lifetime of a fixed abrasive article is extended and wafer-to-wafer uniformity enhanced by preconditioning a fixed abrasive element and/or periodic conditioning after initial wafer polishing. Embodiments include preconditioning by forced removal of an upper binder-rich portion of the fixed abrasive elements to expose abrasive particles having a similar concentration as the bulk concentration at about one half the height of the elements. Embodiments further include periodic conditioning after initial wafer polishing by forced removal of an upper portion of the fixed abrasive elements.

45 Claims, 3 Drawing Sheets

CONDITIONING FIXED ABRASIVE ARTICLES

TECHNICAL FIELD

The present invention relates to a method of conditioning a fixed abrasive article containing a plurality of abrasive elements, to an apparatus for chemical mechanical polishing (CMP) a workpiece with a fixed abrasive article, and to a CMP technique using a fixed abrasive article. The present invention has particular applicability in polishing operations conducted in manufacturing semiconductor devices.

BACKGROUND ART

Abrasive articles enjoy utility in a variety of industrial applications for abrading, finishing and polishing a variety of surfaces. Typical industrial uses of abrasive articles include polishing a substrate, as during various phases in manufacturing semiconductor devices and magnetic recording media. In manufacturing semiconductor devices, a wafer typically undergoes numerous processing steps, including deposition, patterning and etching. After various processing steps it is necessary to achieve a high level of surface planarity and uniformity to enable accurate photolithographic processing. A conventional planarization technique comprises polishing, as by CMP, wherein a wafer carrier assembly is rotated in contact with a polishing pad in a CMP apparatus. The polishing pad is mounted on a rotating/moving turntable or platen driven by an external driving force. The wafers are typically mounted on a carrier or polishing head which provides a controllable force, i.e., pressure, pressing the wafers against the rotating polishing pad. Thus, the CMP apparatus effects polishing or rubbing movement between the surface of each thin semiconductor wafer and the polishing pad while dispersing a polishing slurry containing abrasive particles in a reactive solution to effect both chemical activity and mechanical activity while applying a force between the wafer and a polishing pad.

Conventional polishing pads employed in abrasive slurry processing typically comprise a grooved porous polymeric surface, such as polyurethane, and the abrasive slurry varied in accordance with the particular material undergoing CMP. Basically, the abrasive slurry is impregnated into the pores of the polymeric surface while the grooves convey the abrasive slurry to the wafer undergoing CMP. A polishing pad for use in CMP slurry processing is disclosed by Krywanczyk et al. in U.S. Pat. No. 5,842,910. Typical CMP is performed not only on a silicon wafer itself, but on various dielectric layers, such as silicon oxide, conductive layers, such as aluminum and copper, or a layer containing both conductive and dielectric materials as in damascene processing.

A distinctly different type of abrasive article from the above-mentioned abrasive slurry-type polishing pad is a fixed abrasive article, e.g., fixed abrasive polishing sheet or pad. Such a fixed abrasive article typically comprises a backing with a plurality of geometric abrasive composite elements adhered thereto. The abrasive elements typically comprise a plurality of abrasive particles in a binder, e.g., a polymeric binder. During CMP employing a fixed abrasive article, the substrate or wafer undergoing CMP wears away the fixed abrasive elements thereby releasing the abrasive particles. Accordingly, during CMP employing a fixed abrasive article, a chemical agent is dispersed to provide the chemical activity, while the mechanical activity is provided by the fixed abrasive elements and abrasive particles released therefrom by abrasion with the substrate undergoing CMP. Thus, such fixed abrasive articles do not require the use of a slurry containing loose abrasive particles and advantageously simplify effluent treatment, reduce the cost of consumables and reduce dishing as compared to polishing pads that require an abrasive slurry. During CMP employing a fixed abrasive polishing pad, a chemical agent is applied to the pad, the agent depending upon the particular material or materials undergoing CMP. However, the chemical agent does not contain abrasive particles as in abrasive slurry-type CMP operations. Fixed abrasive articles are disclosed by Rutherford et al. in U.S. Pat. No. 5,692,950, Calhoun in U.S. Pat. No. 5,820,450, Haas et al. in U.S. Pat. No. 5,453,312 and Hibbard et al. in U.S. Pat. No. 5,454,844.

Fixed abrasive elements are typically formed by filling recesses in an embossed carrier with a slurry comprising a plurality of abrasive grains dispersed in a hardening binder precursor and hardening the binder precursor to form individual abrasive composite elements that are laminated to a backing sheet and the embossed carrier removed. The backing sheet containing the individual abrasive composite elements adhered thereto is then typically mounted to a subpad containing a resilient element and a rigid element between the backing sheet and the resilient element. Such mounting can be effected by any of various types of laminating techniques, including the use of an adhesive layer. Methods of forming a backing sheet containing fixed abrasive elements are disclosed by Calhoun in U.S. Pat. No. 5,437,754 as well as Rutherford et al. in U.S. Pat. No. 5,692,950.

Fixed abrasive elements of conventional slurry-less type polishing pads are typically formed in various "positive" geometric configurations, such as a cylindrical, cubical, truncated cylindrical, and truncated pyramidal shapes, as disclosed by Calhoun in U.S. Pat. 5,820,450. Conventional fixed abrasive articles also comprise "negative" abrasive elements, such as disclosed by Ravipati et al. in U.S. Pat. No. 5,014,468.

During CMP, the surface of conventional polymeric polishing pads for abrasive-slurry type CMP operations becomes glazed thus nonreceptive to accommodating and/or dispensing the abrasive slurry and is otherwise incapable of polishing at a satisfactory rate and uniformity. Accordingly, conventional practices comprise periodically conditioning the pad surface so that it is maintained in a proper form for CMP. Conventional conditioning means comprises a diamond or silicon carbide (SiC) conditioning disk to conditioning the polishing pad. After repeated conditioning operations, the pad is eventually consumed and incapable of polishing at a satisfactory rate and uniformity. At this point, the polishing pad must be replaced. During replacement, the CMP apparatus is unavailable for polishing with an attendant significant decrease in production throughput.

On the other hand, fixed abrasive pads do not undergo the same type of adverse smoothing as do conventional polymeric pads. Moreover, a fixed abrasive pad has a low contact ratio (area of the tops of abrasive elements/total pad area), e.g., about 10% to about 25% and short abrasive elements. Periodic pad conditioning with conventional conditioning means would drastically reduce the pad lifetime on a CMP apparatus having a rotating round platen. Preconditioning only would be expected to adversely affect the polishing rate and uniformity stability, i.e., wafer-to-wafer uniformity, since preconditioning with conventional diamond or SiC disks would be expected to render the pad surface significantly different from that caused by pad-wafer interactions. Accordingly, conventional practices on fixed abrasive pads do not involve preconditioning, i.e., prior to initial CMP, or periodic conditioning, after initial CMP. However, the use of fixed abrasive articles, such as polishing pads, disadvantageously results in poor wafer-to-wafer polishing rate stability on a CMP polisher having a rotating round platen or on a polisher with an advanceable polishing sheet at an indexing rate less than 0.5 to 1.0 inch per minute.

Copending U.S. application Ser. No. 09/244,456 filed Feb. 4, 1999 and assigned to the assignee of the present invention discloses a CMP apparatus having a rotatable platen, a polishing station with a generally linear polishing sheet having an exposed portion extending over a top surface of the platen for polishing the substrate, and a drive mechanism to incrementally advance the polishing sheet in a linear direction across a top surface of the platen. The polishing sheet is releasably secured to the platen to rotate with the platen, and it has a width greater than the diameter of the substrate. Thus, an unused portion of the polishing sheet is incrementally advanced or indexed after polishing a wafer, e.g., by exposing about 0.5 inch to about 1 inch per minute of virgin or unused polishing pad surface. In this way, wafer-to-wafer rate stability is improved. The entire disclosure of U.S. application Ser. No. 09/244,456 is hereby incorporated by reference herein. However, indexing of 0.5 to 1 inch per minute of pad significantly reduces the useful life of fixed abrasive polishing sheets, condemning them to the trash bin before the abrasive elements are consumed to any significant extent, thereby significantly increasing manufacturing costs.

There exists a need to extend the useful life of a fixed abrasive article, e.g., polishing sheet or pad, while simultaneously maintaining high wafer-to-wafer rate stability. There also exists a need for a CMP apparatus enabling the use of fixed abrasive polishing pads having an extended life and achieving high wafer-to-wafer rate stability.

DISCLOSURE OF THE INVENTION

An advantage of the present invention is a method of extending the useful life of a fixed abrasive article.

Another advantage of the present invention is a method of extending the useful life of a fixed abrasive article while achieving high wafer-to-wafer polishing rate stability.

Another advantage of the present invention is a method of CMP semiconductor wafers with improved wafer-to-wafer polishing rate stability using a fixed abrasive article.

A further advantage of the present invention is a CMP apparatus containing a rotatable fixed abrasive article with means for extending the useful life of the fixed abrasive article and enabling CMP of wafers with improved wafer-to-wafer polishing rate stability.

Additional advantages and other features of the present invention will be set forth in part in the description which follows and in part will become apparent to those having ordinary skill in the art upon examination of the following or may be learned from the practice of the present invention. The advantages of the present invention may be realized and obtained as particularly pointed out in the appended claims.

According to the present invention, the foregoing and other advantages are achieved in part by a method of preconditioning a fixed abrasive article comprising a plurality of abrasive elements having an upper surface and containing abrasive particles dispersed in a binder, before initial use in polishing a surface of a workpiece, the method comprising removing a portion of the upper surface covering the abrasive particles in the abrasive elements to increase exposed abrasive particles to a desired roughness.

Another aspect of the present invention is a method of CMP a plurality of wafers with a fixed abrasive polishing pad comprising a plurality of abrasive elements adhered to and extending to a height above a backing sheet, the abrasive elements having an upper surface and comprising a plurality of abrasive particles in a binder, the method comprising CMP a first one or more wafers; and subsequently conditioning the polishing pad by removing a portion of the upper surface of the abrasive elements.

Embodiments of the present invention comprise preconditioning a fixed abrasive article to a desired surface roughness by removing the topmost portion of the abrasive elements covered by resin to expose an amount of abrasive particles per unit area substantially corresponding to an average amount of abrasive particles per unit area in the abrasive elements, e.g., the bulk concentration, such as the concentration of abrasive particles at about one half the height of an abrasive element. Embodiments of the present invention also include preconditioning by removing a portion of the upper surface of abrasive elements of a fixed abrasive article, conducting CMP on a first wafer, and subsequently periodically conditioning the fixed abrasive article by removing a surface portion of the fixed abrasive elements.

Another aspect of the present invention is an apparatus for CMP a wafer, the apparatus comprising: a fixed abrasive polishing article comprising a plurality of abrasive elements adhered to a backing sheet, the abrasive elements having an upper surface and comprising a plurality of abrasive particles dispersed in a binder; and means for conditioning the fixed abrasive polishing article by removing a portion of the upper surface of the abrasive elements.

Embodiments of the present invention include a CMP apparatus containing a plurality of polishing stations comprising a platen containing one or more fixed abrasive polishing pads or sheets, each station having an associated conditioning means. Embodiments further include at least one polishing station having a fixed abrasive polishing sheet and a drive mechanism to incrementally advance the polishing sheet in a linear direction across the top surface of the platen on which it is mounted.

Additional advantages of the present invention will become readily apparent to those skilled in this art from the following detailed description, wherein embodiments of the present invention are described, simply by way of illustration of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

DESCRIPTION OF THE INVENTION

The present invention addresses and solves the longevity and wafer-to-wafer polishing rate stability problems attendant upon CMP employing conventional fixed abrasive articles, such as fixed abrasive polishing pads or sheets. It was found that indexing or incrementally advancing the fixed abrasive polishing sheet in a linear direction across the top surface of the rotating platen to expose virgin or unused polishing sheet surface can alleviate the rate uniformity problem, but unfortunately reduces the useful life of a fixed abrasive polishing sheet requiring replacement and, hence, CMP downtime and increases the cost of consumables, thereby adversely impacting production throughput and increasing manufacturing costs. Moreover, in accordance with conventional indexing techniques, the useful life of a fixed abrasive polishing sheet is considered over before any significant consumption of the fixed abrasive elements. The present invention also addresses and solves problems stemming from fluctuations in removal rate during CMP, thereby further enhancing the wafer-to-wafer rate stability when employing a fixed abrasive polishing sheet.

Figure 1:
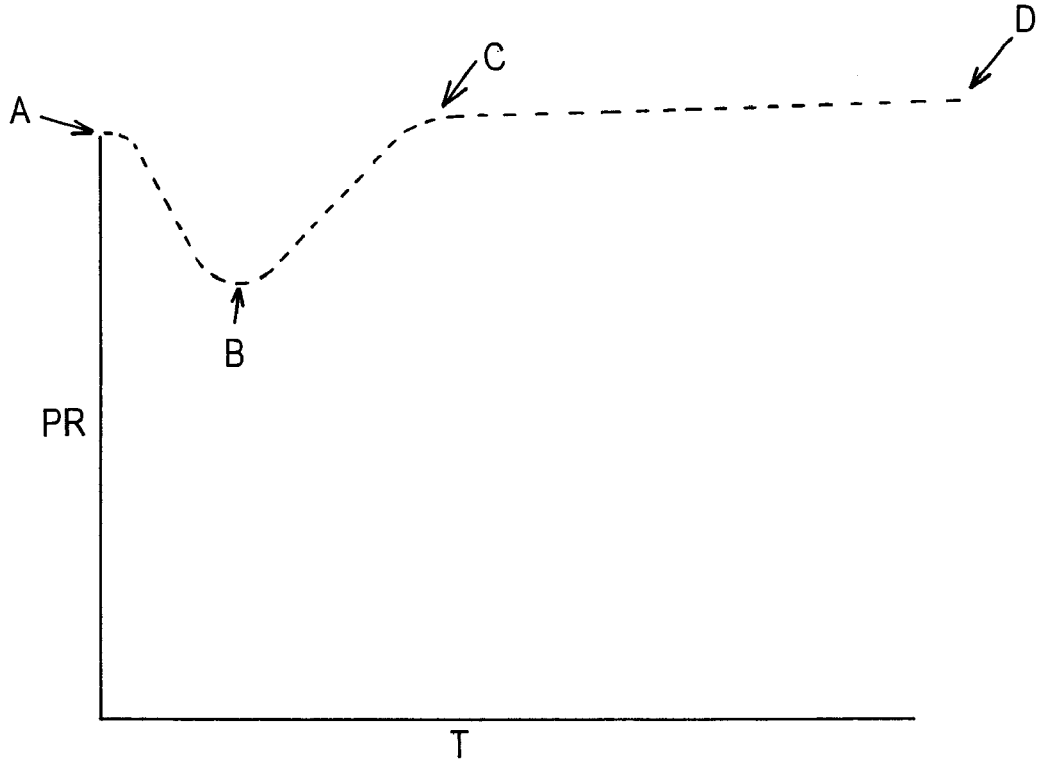
FIG. 1 is a graph showing the fluctuation in polishing rate with time employing a conventional fixed abrasive polishing sheet.

During the course of experimentation and investigation in an attempt to improve the useful life of conventional fixed abrasive articles, such as polishing sheets, conventional indexing was reduced to below 0.5 inches per minute of CMP or indexing avoided altogether using the apparatus and-technique disclosed in copending U.S. application Ser. No. 09/244,456. It was observed that the removal rate (RR) dropped from an initial rate A, as shown in FIG. 1, to a lower rate B as time of CMP (T) continued without indexing. Subsequently, with continued CMP over time, the removal rate increased to a acceptable rate C. Employing conventional indexing, e.g., about 0.5 to about 1 inch per minute of CMP, the removal rate is maintained at about point A without any appreciable decrease in removal rate. Having discovered this phenomenon, investigations were conducted to ascertain the mechanism involved to enable formulating a solution to the fixed abrasive polishing sheet longevity problem. Desirably, CMP would be maintained between points C and D in FIG. 1, thereby significantly reducing the indexing rate to increase pad longevity and maintaining high wafer-to-wafer rate stability.

Figure 2:
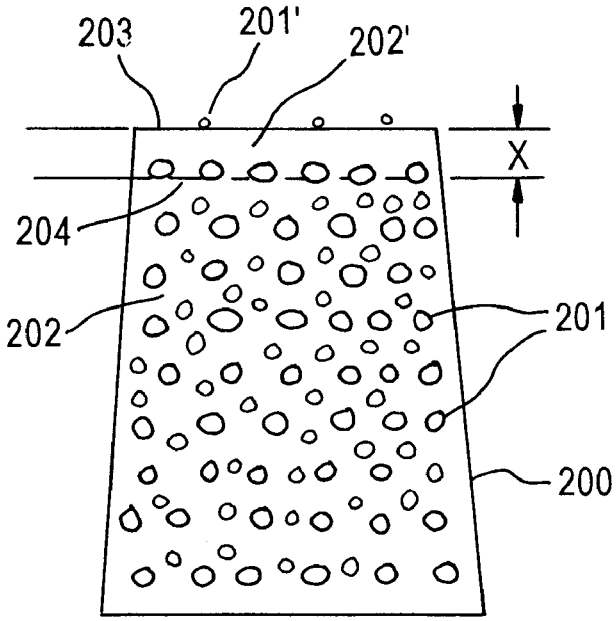
FIG. 2 schematically illustrates the distribution of abrasive particles in a conventional fixed abrasive element.

Upon further investigation and experimentation it was found that conventional virgin or unused fixed abrasive polishing articles, such as sheets, contain abrasive elements comprising a polymer-rich surface with a rather sparse distribution of surface abrasive particles, considerably less than the average bulk distribution of the abrasive particles within the abrasive element. For example, adverting to FIG. 2, a conventional fixed abrasive element 200 comprises a plurality of abrasive particles 201 distributed throughout polymeric matrix 202. While the distribution of abrasive particles 201 throughout the bulk of the abrasive element 200 appears substantially uniform, the upper surface 203, i.e., the working surface which confronts a workpiece, e.g., a wafer, contains a small percentage of surface particles 201' while directly thereunder appears a region containing virtually exclusively polymeric binder 202'. Thus, the distribution of abrasive particles 201 in the upper portion is considerably less than the bulk distribution throughout the remainder of the abrasive element. High indexing rates in accordance with conventional practices confines CMP to the upper particles 201'. Consequently, the useful life of a conventional fixed abrasive polishing sheet is deemed terminated before an appreciable portion of the fixed abrasive element is utilized. The exact reason for unequal distribution of abrasive particles in fixed abrasive elements is not known with certainty. However, it is believed that during the manufacturing process, the mold contains an excess amount of polymeric binder at the portion representing the upper surface and, consequently, the resulting molded article contains a polymer-rich upper surface.

Having uncovered what is believed to be a significant source of the fixed abrasive polishing sheet longevity dilemma, embodiments of the present invention comprise preconditioning a fixed abrasive polishing sheet to a desired surface roughness to achieve substantial wafer-to-wafer uniformity or uniformity stability by removing a small portion of the upper surface X (FIG. 2) as shown by dotted line 204, to present to a workpiece to be polished a distribution of abrasive particles 201 substantially consistent with the bulk distribution of abrasive particles in abrasive element 200 for a designed surface roughness. This objective can be achieved by removing about one micron to about 3 microns, e.g., about 2 microns, of the surface portion of conventional abrasive elements of a fixed abrasive article which typically have a height of about 40 microns to about 50 microns above the backing sheet to which they are adhered.

Preconditioning or removal of the upper portion of fixed abrasive elements in accordance with embodiments of the present invention can be implemented in any of various ways, as by abrasion. In conducting such abrasion, conventional preconditioning plates and diamond disks, such as those previously employed in conditioning polymeric polishing pads for abrasive-slurry type CMP, can be employed. In addition, preconditioning in accordance with embodiments of the present invention can be implemented by abrading a portion of the upper surface of fixed abrasive elements employing another fixed abrasive article or a portion of the same fixed abrasive article by bringing the working surfaces in face to face frictional contact.

In accordance with embodiments of the present invention, preconditioning by removing an upper surface portion of the fixed abrasive elements effectively conditions the fixed abrasive article such that CMP is initiated substantially at a point c as shown in FIG. 1. Consequently, indexing can be conducted considerably below the conventional minimum of 0.5 inch per minute of CMP while maintaining high wafer-to-wafer rate stability since the rapid decrease in removal rate is not experienced as when conducting CMP employing an unused, unpreconditioned fixed abrasive polishing sheet. Thus, the useful life of a fixed abrasive polishing sheet is increased without sacrificing wafer-to-wafer rate stability.

Upon further experiment and investigation, fluctuations in removal rate were encountered during CMP employing conventional fixed abrasive polishing sheets with little or no indexing. It is believed that such removal rate fluctuations are due to fluctuations in friction due to temperature changes, the particular chemical agent employed, and pressure changes. For example, it is desirable to conduct CMP at a desired removal rate, e.g., about 3,000 Å to about 4,000 Å/minute. However, due to friction fluctuations, the removal rate can escalate to about 8,000 Å per minute or plunge to less than 1,000 Å per minute. Consequently, wafer-to-wafer rate stability disadvantageously decreases.

The present invention addresses and solves such removal rate fluctuations by conducting periodic conditioning subsequent to CMP at least one wafer. While the precise mechanism involved in alleviating removal rate fluctuations by conditioning in accordance with embodiments of the present invention is not known with certainty, it is believed that during CMP the matrix binder and abrasive particles are abraded at different rates, thereby altering the frictional characteristics of the abrading surface. Periodic conditioning during CMP is believed to restore the desired surface roughness of the abrading surfaces of the fixed abrasive elements, thereby reducing friction fluctuations which cause removal rate fluctuations. Such conditioning subsequent to initial CMP can be implemented in the same manner and with the same tool as the preconditioning treatment previously discussed.

The present invention, therefore, includes methods of CMP comprising initially preconditioning a fixed abrasive particle, such as a fixed abrasive polishing sheet or pad to a desired surface roughness, by removing a portion of the upper surface of the abrasive elements to increase the amount of abrasive particles exposed and periodically conditioning the fixed abrasive polishing sheet, subsequent to initial CMP of at least one wafer, to maintain the desired surface roughness of the surface of the abrasive elements. Such conditioning can be conducted in situ, i.e., during CMP, or ex situ, i.e., between wafer polishing.

Embodiments of the present invention include modifications of the linear indexing type of CMP apparatus disclosed in copending U.S. application Ser. No. 09/244,456 by providing conditioning means, such as a diamond conditioner head, in association with the rotating linearly indexing fixed abrasive polishing station, and/or mounting a substantially circular fixed abrasive polishing pad on one or more rotating platens in lieu of abrasive slurry type polymeric polishing pads. Thus, the entire CMP apparatus disclosed in copending U.S. application Ser. No. 09/244,456 can contain fixed abrasive polishing articles.

Figure 3:
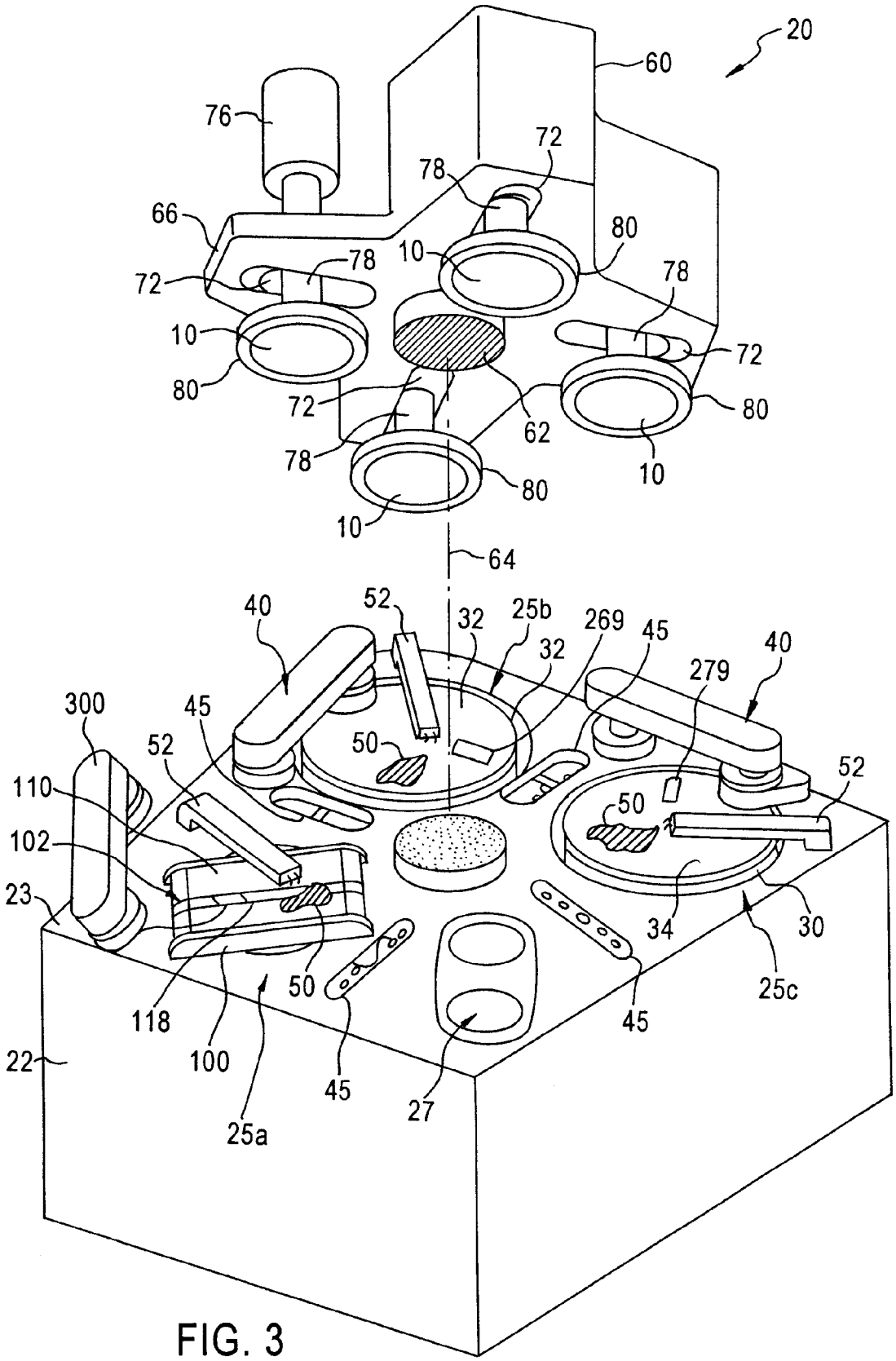
FIG. 3 is a schematic exploded perspective view of a CMP apparatus in accordance with an embodiment of the present invention.

FIG. 3 substantially corresponds to FIG. 1 of copending U.S. application Ser. No. 09/244,456 but includes additional means 300 for preconditioning/ conditioning the fixed abrasive polishing sheet of polishing cartridge 102. The additional elements of the CMP apparatus disclosed in FIG. 1 are disclosed in copending U.S. application Ser. No. 09/244,456 and, hence, not elaborated upon herein in detail as the entire disclosure of copending U.S. application Ser. No. 09/244, 456 have been incorporated herein in its entirety. However, to facilitate understanding, the additional elements are briefly mentioned. Thus, CMP apparatus 20 depicted in FIG. 3 comprises machine base 22 with table top 23 supporting polishing stations 25*a*, 25*b* and 25*c*, and transfer station 27 for, inter alia, receiving individual substrates 10 loading them and transferring them back to the loading apparatus. Polishing station 25*a* includes the linearly indexing rotatable polishing device containing a fixed abrasive polishing sheet. Thus, polishing station 25*a* includes polishing cartridge 102 mounted to rotatable, rectangular platen 100. Polishing cartridge 102 includes a linearly advancing fixed abrasive sheet or belt. Embodiments of the present invention include a CMP apparatus comprising one or more polishing stations 25*a* that include a polishing cartridge with a fixed abrasive polishing belt. Embodiments of the present invention also comprise a CMP apparatus with one or more linear polishing stations.

Polishing station 25*b* and polishing station 25*c* may include "standard" polishing pads 32 and 34, respectively, each adhesively attached to a substantially circular platen 30. Such "standard" polishing pads are formed of porous, grooved polymeric material and function in association with abrasive-type slurries applied thereto. Alternatively, in accordance with embodiments of the present invention, one or both of polishing stations 25*b* and 25*c* can comprise substantially circular fixed abrasive polishing pads with associated conditioning means 40. Each platen is typically connected to a platen drive modem (not shown) that rotates the platen at about 30 to about 200 revolutions per minute, although lower or higher rotational speeds can be employed. For proper prospective of dimensions, at substrate 10 is an eight inch diameter disk (about 200 millimeters), rectangular platen 100 can be about 20 inches on a side, and circular platen 30 and polishing pads 32 and 34 can be about 30 inches in diameter.

Each polishing station 25*a*, 25*b* and 25*c* also includes a combined slurry/rinse arm 52 projecting over the associated polishing surface. Each slurry/rinse arm 52 may include two or more slurry supplied tubes to provide a polishing liquid or cleaning liquid to the surface of the polishing sheet or pad. The polishing liquid dispensed onto the fixed- abrasive polishing sheet or pad does not include abrasive particles; however, when employing "standard" polishing pads, the slurry would include abrasive particles. Typically, sufficient liquid is provided to cover and wet the entire polishing sheet or pad. Each slurry/rinse arm also includes several spray nozzles (not shown) which provide a high pressure rinse at the end of each polishing and conditioning cycle.

In accordance with embodiments of the present invention, polishing station 25*a* includes an associated pad conditioner apparatus 300. Polishing stations 25*b* and 25*c*, including an associated pad conditioner 40, can be mounted with either standard polymeric polishing pads or fixed abrasive polishing pads. Optional cleaning/rinsing stations 45 may be positioned between polishing stations and the transfer stations for cleaning/rinsing the substrate as it moves between the stations.

A rotatable multi-head carousel 60 is supported above the polishing stations by a center post 62 and rotated about a carousel axis 64 by a carousel motor assembly (not shown). Carousel 60 includes four carrier head systems mounted on carousel support plate 66 at equal angular intervals about carousel axis 64. Three of the carrier head systems receive and hold substrates, and polish them by pressing them against the polishing sheet of station 25 and the polishing pads of 25*b* and 25*c*.

Each carrier head system includes a carrier or carrier head 80, a carrier drive shaft 78 connecting a carrier head rotation modem 76 (not shown) by the removal of one quarter of the carousel cover, to carrier head 80 so that each carrier head can independently rotate about its own axis. Carrier head 80 also independently laterally oscillates in a radial slot 72 formed in carousel support plate 66.

Figure 4:
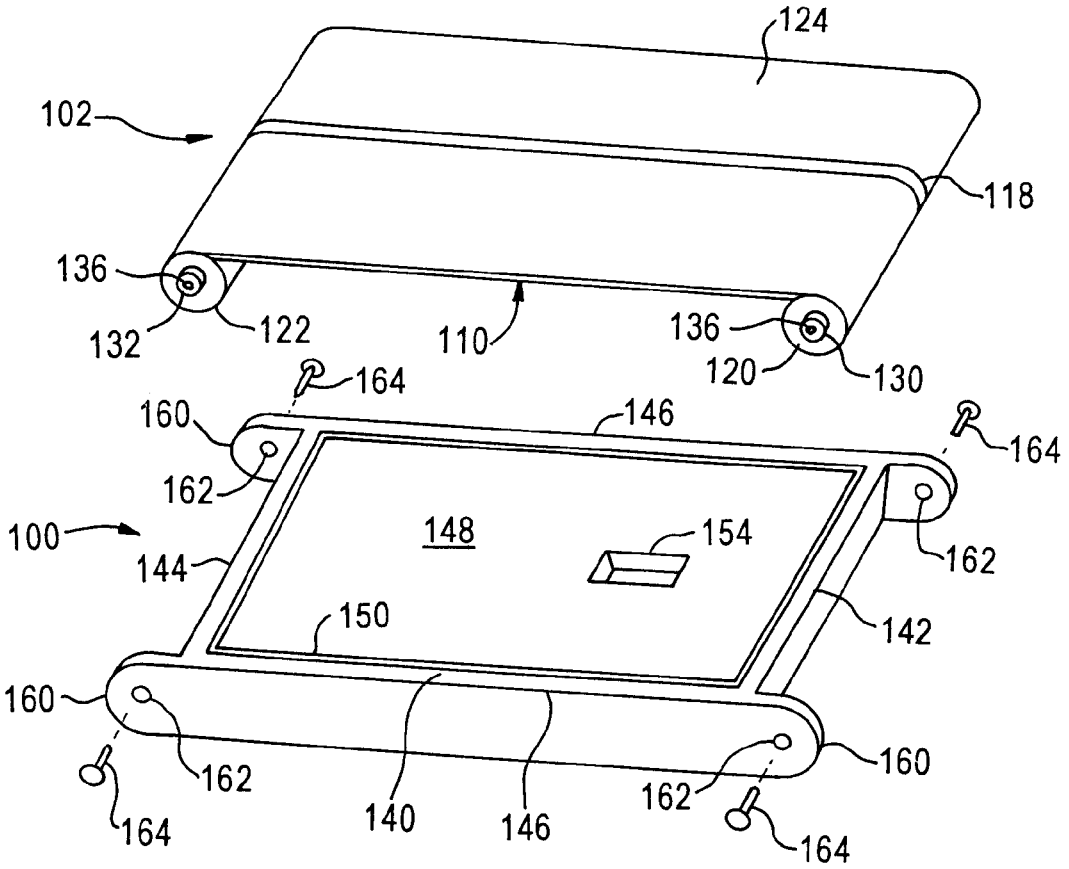
FIG. 4 is a schematic exploded perspective view of a rectangular platen and a polishing cartridge.

Adverting to FIG. 4, which substantially corresponds to FIG. 3B of copending U.S. application Ser. No. 09/244,456, polishing cartridge 102 is detachably secured to rectangular platen 100 at polishing station 25*a*. Polishing cartridge 102 includes feed roller 130, take-up roller 132, and a generally linear sheet or belt 110 of a polishing pad material. An unused or "fresh" portion 120 of the polishing sheet is wrapped around feed roller 130, and a used portion 122 of the polishing sheet is wrapped around take-up roller 132. A rectangular exposed portion 124 of the polishing sheet that is used to polish the substrate extends between the used and unused portions 120, 122 over a top surface 140 of rectangular platen 100. The fixed-abrasive polishing sheet 110 can be about 20 inches wide and about 0.005 inches thick and may include an upper layer which is an abrasive composite composed of abrasive grains held or embedded in a binder material. Typically, the abrasive grains have a particle size of about 0.1 and about 1,500 microns. Such abrasive grains can include silicon oxide, fused aluminum oxide, ceramic aluminum, green silicon carbide, silicon carbide, chroma, alumina zirconia, diamond, iron oxide, ceria, cubic boron nitride, garnet, and combinations thereof. The binder may be derived from a precursor which includes an organic polimerizable resin which is cured to form the binder material. Examples of such resins include phenolic resins, urea-formaldehyde resins, melamine formaldehyde resins, acrylated urethanes, acrylated epoxies, ethylenically unsaturated compounds, aminoplast derivatives having at least one dependent acrylate group, isocyanurate derivatives having at least one pendent acrylate group, vinyl ethers, epoxy resins and combinations thereof. The lower layer is a backing layer composed of materials such as a polymeric film, paper, cloth or metallic film.

A transparent strip 118 (FIG. 4) can be formed along the length of polishing sheet 110 at about its center and may be about 0.6 inches wide, by excluding abrasive particles from this region. The transparent strip can be aligned with an aperture or transparent window 154 in the rectangular platen 100 for optical monitoring of the substrate surface for end point detection or in situ rate monitoring as discussed in copending U.S. application Ser. No. 09/244,456.

Feed and take-up rollers 130 and 132 should be slightly longer than the width of polishing sheet 100. Rollers 130, 132 may be plastic or metal cylinders about 20 inches long and about 2 inches in diameter. Rectangular platen 100 includes a generally planar rectangular top surface 140 bounded by a feed edge 142, a take-up edge 144, and two parallel lateral edges 146. A groove 150 is formed in top surface 140 and may be generally rectangular extending along edges 142–146. A passage (not shown) through platen 100 connects groove 150 to vacuum source 200 (not shown), to provide vacuum chucking thereby ensuring that lateral forces caused by friction between the substrate and polishing sheet during polishing do not force the polishing sheet off the platen or cause wrinkles on the fixed abrasive pad. Central region 148 of top surface 140 is free of grooves to prevent potential deflection of the polishing sheet into the grooves from interfering with polishing uniformity. Floor retainers 160 hold feed and take-up rollers 130, 132 at feed and take-up edges 142 and 144, respectively. Each retainer 160 includes an aperture 162 with an associated pin 164 extending through apertures 162 to rotatable connect rollers 130 and 132 to platen 100. Feed roller 130 is slipped into the spaced between the two retainers along feed edge 142, and two pins 164 are inserted through opposing apertures 162 and retainers 160 to engage the two opposing recesses of the feed up roller. Take-up roller 132 is mounted to platen 100 by slipping it into place between the retainers along take-up edge 144 and inserting two pins 164 through the opposing apertures 162 to engage the two opposing recesses of the take-up roller.

Figure 5:
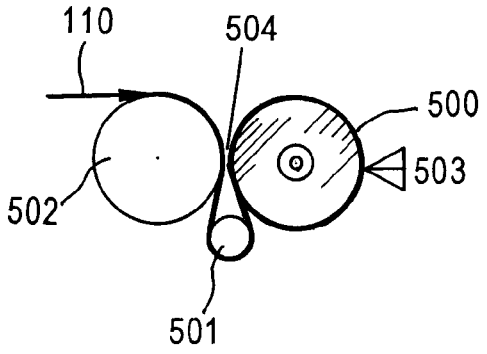
FIG. 5 illustrates an arrangement of rollers for conditioning a fixed abrasive polishing sheet in accordance with an embodiment of the present invention.

An embodiment of the present invention includes a modification of feed roller 130 so that the fixed abrasive polishing sheet is fed in face to face frictional contact with itself, thereby effecting conditioning which may be employed in conjunction with or in lieu of conditioning element 300 (FIG. 3). For example, adverting to FIG. 5, feed roller 130 can be replaced with a combination of feed roller 500, idle roller 501 and friction roller 502 for advancing fixed abrasive polishing sheet 110. Urging means 503 can be provided for urging feed roller 500 toward friction roller 502 to establish frictional abrasive contact between portions of the working surface of fixed abrasive belt 110.

The present invention significantly enhances the useful life of conventional fixed abrasive articles, such as polishing sheets or pads, by preconditioning to remove an upper portion of the surface of fixed abrasive elements to a desired roughness thereby increasing the amount of abrasive particles exposed to that substantially corresponding to the average number of abrasive particles per unit area. Preconditioning avoids the necessity of lengthy indexing, thereby increasing sheet life without adversely impacting wafer-to-wafer uniformity. Embodiments of the present invention further include conditioning after CMP, either in situ or ex situ, to prevent fluctuations in polishing rate, thereby further improving wafer-to-wafer uniformity.

The present invention is applicable to all types of fixed abrasive articles and apparatus, including rotating polishing pads that are substantially circular, substantially rectangular rotating polishing sheets involving linear indexing and linear polishing sheets, and apparatus containing one or more polishing stations utilizing such fixed abrasive elements. The present invention provides wafer-to-wafer rate stability for CMP and can be employed during various phases of semiconductor device manufacturing. The present invention, therefore, enjoys utility in various industrial applications, particularly in CMP in the semiconductor industry as well as the magnetic recording media industry.

Only the preferred embodiment of the present invention and but a few examples of its versatility are shown and described in the present disclosure. It is to be understood that the present invention is capable of use in various other combinations and environments and is capable of changes and modifications within the scope of the inventive concept as expressed herein.

What is claimed is:

1. A method for preconditioning a chemical-mechanical polishing fixed abrasive article having a plurality of abrasive elements, comprising:

removing a portion of an upper portion of the abrasive elements of the article to expose an amount of abrasive particles per unit area substantially corresponding to an average amount of abrasive particles per unit area in the abrasive elements.

2. The method according to claim 1, wherein the abrasive elements are adhered to and extend to a height above a backing sheet, and removing a portion of the upper portion comprises exposing an amount of abrasive particles per unit area substantially corresponding to an average amount of abrasive particles per unit area at about one half the height of the abrasive elements.

3. The method according to claim 2, wherein the abrasive elements extend to a height of about 40 to about 50 microns above the backing sheet, and removing the upper portion comprises removing about 1 to about 3 microns from the upper portion of the abrasive elements.

4. The method according to claim 1, wherein the abrasive particles comprise alumina or ceria and the binder comprises a polymer.

5. The method according to claim 1, wherein removing a portion of the upper portion comprises mechanical abrasion.

6. The method according to claim 1, wherein removing a portion of the upper portion of the abrasive elements comprises contacting the portion of the upper portion with a tool comprising abrasive particles in a binder.

7. The method according to claim 1, wherein removing a portion of the upper portion of the abrasive elements comprises contacting the portion of the upper portion with another fixed abrasive element.

8. The method according to claim 1, wherein mechanically removing at least a portion of the upper portion of the abrasive elements comprises contacting the portion of the upper portion with a working surface of the fixed abrasive article by bringing the working surface in face to face frictional contact.

9. The method according to claim 1, wherein about 1 to about 3 microns are removed from the upper portion of the abrasive elements to expose an amount of abrasive particles per unit area substantially corresponding to an amount of abrasive particles per unit area at about one half the height of the abrasive elements.

10. A method for chemical-mechanical polishing a plurality of wafers with a fixed abrasive polishing pad comprising a plurality of abrasive elements adhered to and extending to a height above a backing sheet, the abrasive elements having an upper portion and comprising a plurality of abrasive particles dispersed in a binder, the method comprising:

preconditioning the polishing pad by removing a portion of the upper portion of the abrasive elements to expose an amount of abrasive particles per unit area substantially corresponding to an average amount of abrasive particles per unit area in the abrasive elements;

chemical-mechanical polishing one or more wafers; and subsequently conditioning the polishing pad by removing another portion of the upper portion of the abrasive elements to increase wafer-to-wafer polishing rate stability.

11. The method according to claim 10, wherein about 1 to about 3 microns are removed from the upper portion of the abrasive elements.

12. The method according to claim 10, wherein the abrasive particles comprise alumina or ceria and the binder comprises a polymer.

13. The method according to claim 10, wherein preconditioning and conditioning the polishing pad comprises abrading the upper portion of the abrasive elements.

14. The method according to claim 13, wherein abrading the upper portion of the abrasive elements comprises contacting the upper portion with a tool comprising abrasive particles in a binder.

15. The method according to claim 13, wherein abrading the upper portion of the abrasive elements comprises contacting the upper portion with a fixed abrasive element.

16. The method according to claim 10, further comprising indexing the polishing pad after chemical-mechanical polishing each wafer by exposing a section of the polishing pad not previously employed for chemical-mechanical polishing.

17. An apparatus for chemical-mechanical polishing a wafer, comprising:

one or more polishing stations having a rotatable platen and a fixed abrasive polishing article secured to a top surface of the rotatable platen, wherein the fixed abrasive polishing article comprises a plurality of abrasive elements adhered to a backing sheet, wherein the abrasive elements comprise an upper portion and a plurality of abrasive particles dispersed in a binder; and a means for conditioning the fixed abrasive polishing article by removing a portion of the upper portion of the abrasive elements to a desired roughness, wherein the means for conditioning comprises the drive mechanism which incrementally advances the fixed abrasive polishing article in a linear direction across the top surface of the rotatable platen and aligns working surfaces of the fixed abrasive polishing article in face to face abrasive contact.

18. The apparatus according to claim 17, wherein the means for conditioning further comprises:

a rotatable arm having an independently rotating conditioning head disposed thereon; and a washing basin.

19. The apparatus according to claim 18, wherein the conditioning head comprises a pad containing abrasive particles dispersed in a binder.

20. The apparatus according to claim 17, wherein the fixed abrasive polishing article comprises a substantially linear polishing sheet releasably secured to a top surface of the platen, the polishing sheet having an exposed portion extending over the top surface of the platen for polishing a wafer and having a width greater than a diameter of the wafer.

21. The apparatus according to claim 17, further comprising one or more polishing stations having a rotatable platen and a substantially circular, fixed abrasive polishing article secured thereon to rotate with the platen, wherein the means for conditioning fixed abrasive polishing article removes a portion of an upper portion of abrasive elements to a desired roughness conditions disposed on the substantially circular, fixed abrasive polishing article secured thereon.

22. The apparatus according to claim 17, wherein the fixed abrasive polishing article is a substantially linear, fixed abrasive polishing pad.

23. The apparatus according to claim 17, wherein the fixed abrasive polishing article is a substantially circular, fixed abrasive polishing pad.

24. A method for chemical-mechanical polishing, comprising:

providing at least one fixed abrasive polishing pad comprising a plurality of abrasive elements disposed on and extending to a height above a backing sheet, wherein the abrasive elements comprise an upper portion and a plurality of abrasive particles dispersed in a binder;

chemical-mechanical polishing one or more wafers; and then conditioning the polishing pad by removing a portion of the upper portion of the abrasive elements to expose an amount of abrasive particles per unit area substantially corresponding to an average amount of abrasive particles per unit area in the abrasive elements.

25. The method according to claim 24, wherein conditioning the polishing pad increases wafer-to-wafer polishing rate stability.

26. The method according to claim 24, further comprising preconditioning the polishing pad by removing a portion of the upper portion to form an exposed upper portion having a desired roughness before chemical-mechanical polishing the one or more wafers.

27. The method according to claim 24, wherein the abrasive elements are adhered to and extend to a height above a backing sheet, and removing a portion of the upper portion comprises exposing an amount of abrasive particles per unit area substantially corresponding to an average amount of abrasive particles per unit area at about one half the height of the abrasive elements.

28. The method according to claim 24, wherein the abrasive elements extend to a height of about 40 to 50 microns above the backing sheet.

29. The method according to claim 28, wherein conditioning and preconditioning by mechanically removing a portion of the upper portion removes about 1 to about 3 microns from the upper portion of the abrasive elements to expose an amount of abrasive particles per unit area substantially corresponding to an amount of abrasive particles per unit area at about one half the height of the abrasive elements.

30. The method according to claim 24, wherein the abrasive particles comprise alumina or ceria; and the binder comprises a polymer.

31. The method according to claim 24, wherein removing a portion of the upper portion comprises mechanical abrasion.

32. The method according to claim 31, wherein removing a portion of the upper portion of the abrasive elements comprises contacting the portion of the upper portion with a tool comprising abrasive particles in a binder.

33. The method according to claim 31, wherein removing a portion of the upper portion of the abrasive elements comprises contacting a portion of the upper portion with another fixed abrasive element.

34. The method according to claim 31, wherein removing a portion of the upper portion of the abrasive elements comprises contacting the portion of the upper portion with a working surface of the fixed abrasive article by bringing the working surface in face to face frictional contact.

35. The method according to claim 24, further comprising indexing the polishing pad after chemical-mechanical polishing each wafer to expose a portion of the polishing pad not previously employed for chemical-mechanical polishing.

36. The method according to claim 24, wherein mechanically removing at least a portion of the upper portion of the abrasive elements comprises contacting the portion of the upper portion with a working surface of the fixed abrasive article by bringing the working surface in face to face frictional contact.

37. A method for preconditioning a fixed abrasive article having a plurality of abrasive elements, comprising:

removing a portion of an upper portion of the abrasive elements adhered to and extend to a height above a backing sheet to expose an amount of abrasive particles per unit area substantially corresponding to an amount of abrasive particles per unit area at about one half the height of the abrasive elements.

38. The method according to claim 37, wherein about 1 to about 3 microns are removed from the upper portion of the abrasive elements.

39. The method according to claim 37, wherein the abrasive elements extend to a height of about 40 to about 50 microns above the backing sheet, and removing the upper portion comprises removing about 1 to about 3 microns from the upper portion of the abrasive elements.

40. The method according to claim 37, wherein the abrasive particles comprise alumina or ceria and the binder comprises a polymer.

41. The method according to claim 37, wherein removing a portion of the upper portion comprises mechanical abrasion.

42. The method according to claim 37, wherein removing a portion of the upper portion of the abrasive elements comprises contacting the portion of the upper portion with a tool comprising abrasive particles in a binder.

43. The method according to claim 37, wherein removing a portion of the upper portion of the abrasive elements comprises contacting the portion of the upper portion with another fixed abrasive element.

44. The method according to claim 37, wherein mechanically removing at least a portion of the upper portion of the abrasive elements comprises contacting the portion of the upper portion with a working surface of the fixed abrasive article by bringing the working surface in face to face frictional contact.

45. A method for preconditioning a fixed abrasive article having a plurality of abrasive elements, comprising:

removing a portion of an upper portion of the abrasive elements to expose an amount of abrasive particles per unit area substantially corresponding to an average amount of abrasive particles per unit area in the abrasive elements, wherein the abrasive elements comprise a plurality of abrasive particles dispersed in a polymer binder.

* * * * *

UNITED STATES PATENT AND TRADEMARK OFFICE

CERTIFICATE OF CORRECTION

PATENT NO. : 6,322,427 B1
DATED : November 27, 2001
INVENTOR(S) : Li et al.

It is certified that error appears in the above-identified patent and that said Letters Patent is hereby corrected as shown below:

Title page,
Item [56], References Cited, U.S. PATENT DOCUMENTS, for 5,916,012, please replace "3/1999" with -- 6/1999 --

Column 5,
Line 28, please replace "and-technique with -- and technique --.

Column 10,
Line 51, please replace claim 4 with the following: -- The method according to claim 1, wherein the abrasive elements comprise abrasive particles selected from the group of alumina, ceria, or combinations thereof, disposed in a polymer binder. --.

Signed and Sealed this

Tenth Day of June, 2003

JAMES E. ROGAN
*Director of the United States Patent and Trademark Office*